US007648252B2

(12) United States Patent
Hawkins et al.

(10) Patent No.: US 7,648,252 B2
(45) Date of Patent: Jan. 19, 2010

(54) LIGHTING FIXTURE WITH EMI/RFI ELECTRICALLY CONDUCTIVE SHIELDING GRID

(75) Inventors: James Hawkins, Lake Bluff, IL (US); Glenn Gorsiski, Racine, WI (US)

(73) Assignee: Kenall Mfg. Co., Gurnee, IL (US)

( * ) Notice: Subject to any disclaimer, the term of this patent is extended or adjusted under 35 U.S.C. 154(b) by 0 days.

(21) Appl. No.: 12/276,591

(22) Filed: Nov. 24, 2008

(65) Prior Publication Data

US 2009/0072745 A1 Mar. 19, 2009

Related U.S. Application Data

(63) Continuation of application No. 11/691,759, filed on Mar. 27, 2007.

(60) Provisional application No. 60/786,804, filed on Mar. 28, 2006.

(51) Int. Cl.
*F21V 1/00* (2006.01)
*F21S 4/00* (2006.01)

(52) U.S. Cl. ..... 362/225; 362/248; 362/217.03

(58) Field of Classification Search ..... 362/221–225, 362/330, 147–150, 217.03, 248, 358, 279, 362/290–292, 325, 342, 354, 263; 174/382; 313/324

See application file for complete search history.

(56) References Cited

U.S. PATENT DOCUMENTS

| | | | | | |
|---|---|---|---|---|---|
| 3,456,103 | A | * | 7/1969 | Bond | 362/267 |
| 3,564,234 | A | | 2/1971 | Phlieger, Jr. | |
| 3,801,808 | A | | 4/1974 | Johnson | |
| 3,885,150 | A | * | 5/1975 | Ott | 362/263 |
| 4,418,378 | A | * | 11/1983 | Johnson | 362/217.08 |
| 4,722,028 | A | * | 1/1988 | Brannon et al. | 362/29 |
| 5,195,822 | A | * | 3/1993 | Takahashi et al. | 362/296.04 |
| 5,702,179 | A | | 12/1997 | Sidwell et al. | |
| 5,882,108 | A | * | 3/1999 | Fraizer | 362/293 |
| 5,902,035 | A | | 5/1999 | Mui | |
| 6,153,982 | A | | 11/2000 | Reiners | |
| 6,297,583 | B1 | | 10/2001 | Kohne et al. | |
| 6,341,879 | B1 | | 1/2002 | Skinner et al. | |
| 2004/0114372 | A1 | | 6/2004 | Han et al. | |

* cited by examiner

*Primary Examiner*—Bao Q Truong
(74) *Attorney, Agent, or Firm*—Jansson Shupe & Munger Ltd.

(57) ABSTRACT

A lighting fixture for use in an environment which requires protection from EMI/RFI emissions. The fixture comprises a body forming a light-emitting opening, lighting components including at least one lamp in the body, a lens covering the opening, and a conductive grid across the opening, the grid being separate from the lens, electrically connected to the body, and positioned between the lighting components and the opening.

18 Claims, 8 Drawing Sheets

LIGHTING FIXTURE WITH EMI/RFI ELECTRICALLY CONDUCTIVE SHIELDING GRID

RELATED APPLICATION

This application is a continuation of U.S. application Ser. No. 11/691,759, the contents of which are incorporated by reference herein in its entirety. This application also claims the benefit of U.S. Provisional Application No. 60/786,804 filed on Mar. 28, 2006, the contents of which are incorporated by reference herein in its entirety.

FIELD OF THE INVENTION

This invention is related generally to interior luminaires and more particularly to lighting fixtures which prevent unwanted EMI/RFI emissions from radiating from the lighting fixtures, most particularly luminaires used in hospital operating rooms.

BACKGROUND OF THE INVENTION

Many ceiling-mounted fluorescent luminaires used in locations such as hospital surgical suites or research laboratories require shielding to protect the location from electromagnetic interference and radio frequency interference (EMI/RFI). This is generally accomplished using a combination of metal housings and filters. When higher levels of protection are necessary, a metallic paint layer is silk-screened onto the smooth inside surface of the lens of the fixture.

The metallic paint layer is then electrically connected to the metal fixture housing of the light. The goal of using a metallic paint on the lens of a metallic lighting fixture is to encase all of the electrical components of the lighting fixture in a metallic enclosure, thereby preventing EMI and RFI from escaping into the environment outside of the fixture. Such an enclosure is known as a Faraday cage. Since the primary use of lighting fixtures is to provide light, light-emitting openings which allow light to pass are necessary, and something other than a solid metallic surface is required. A very thin layer of metallic paint has been used to create the conductive enclosure. The present invention utilizes a metallic grid to create a more effective Faraday cage and a more durable and robust fixture.

Electromagnetic waves do not penetrate very well through holes that are less than about a wavelength across. Therefore, it is possible to prevent the escape of the EMI/RFI radiation generated by the electrical components within a lighting fixture by ensuring that the openings (areas without a conducting surface) are sized less than some fraction of the shortest wavelength of being generated within the fixture—and the smaller the opening, the more effective it is at blocking the penetration.

The basic physical relationship is frequency $f=c/\lambda$, where frequency is in cycles per second, c=speed of light, and $\lambda$=wavelength, all in a consistent set of units. The speed of light c is approximately $3\times10^{10}$ centimeters per second (cm/sec). Therefore, with a metallic grid which has openings on the order of one centimeter (cm) across, electromagnetic radiation having a frequency of $3\times10^{10}$ cycles per second (300 GHz) will be blocked to some degree, and electromagnetic radiation at a fraction of this frequency will be more effectively blocked from penetrating a metallic grid.

The shielding effectiveness of a metallic grid also depends on the electrical properties of the metallic grid such as the conductivity of the grid material and the gauge of the grid elements. A grid made from heavier gauge material will be a better conductor than one made with thinner material and thus a more effective shield.

Various lighting fixtures have been developed to include an enclosure around the lamps to prevent electrical interference. Examples of such prior art fixtures are those disclosed in the following United States patents: U.S. Pat. No. 3,564,234 (Phlieger), U.S. Pat. No. 5,195,822 (Takahashi, et al.), U.S. Pat. No. 6,297,583 (Kolme, et al.), U.S. Pat. No. 6,153,982 (Reiners), U.S. Pat. No. 5,702,179 (Sidwell et al.), U.S. Pat. No. 5,882,108 (Frazier), and U.S. Pat. No. 5,902,035 (Mui).

Some lighting fixtures in the prior art having an EMI/RFI shield have a number of shortcomings. Lighting fixtures having an EMI/RFI shield that consists of a thin, silk-screened layer of conductive paint on the fixture lens lack the durability often required in various applications. The thin metallic layer is fragile and easily damaged, both during manufacturing as well as in service. The uniformity of layer thickness is also a problem, causing inconsistent resistance readings across the conductive layer, less effective shielding and uneven optical performance. Damage due to unwanted contact with the layer and inconsistent layer thickness during application result in diminished shielding performance and higher cost.

The use of electronic dimming ballasts in such lighting fixtures introduces a more severe shielding requirement because of the frequencies of the EMI/RFI which are produced by such ballasts. However, the use of dimming ballasts is desirable in many applications, particularly in hospital operating room environments. The shielding achievable with silk-screened conductive paint applied to the fixture lens is inadequate to deal with such severe shielding demands.

When using a lighting fixture in a medical setting, it is particularly important that the fixture be durable and able to be cleaned. Lighting fixtures with an EMI/RFI shield are routinely used in hospital surgical suites or research laboratories, and given the sterile atmosphere that accompanies these locations, the lighting fixtures are routinely sanitized. Therefore, it would be desirable to have a lighting fixture which is both robust and easy to clean. Such fixtures must be strong enough to withstand numerous and frequent cleanings and also must allow easy access for cleaning. Furthermore, in order to be easily cleaned, the outer surfaces of the fixtures should be configured to avoid the collection and trapping of dirt and permit the entire outer surface to be cleaned effectively. Thus, for these several reasons, it is desirable to eliminate the silk-screened shielding layer for lighting fixtures requiring EMI/RFI shielding.

In EMI/RFI shielded lighting fixtures, it is desirable that the components of the fixture, other than the shield across the light-emitting opening, also complete an effective Faraday cage in order to shield the environment from EMI/RFI radiation. In applications such as the medical applications mentioned above, the remaining parts of the fixture must withstand the same frequent cleanings and not impede effective cleaning of the fixture. Thus, it would be desirable that such a fixture have smooth sealed outer elements to ensure ease and effectiveness of cleaning and to ensure that the conductive elements which comprise the Faraday cage are adequately connected electrically for shielding effectiveness. It is also desirable that the light emitted through the lens be a large percentage of the light produced by the lamps in the lighting Fixture.

In summary, there are a number of problems and shortcomings in prior lighting fixtures with an EMI/RFI shield.

OBJECTS OF THE INVENTION

It is an object of this invention to provide a shield for lighting fixtures that includes increased EMI/RFI protection while overcoming some of the problems and shortcomings associated with the prior art.

Another object is to provide an EMI/RFI shield for lighting fixtures which provides effective EMI/RFI shielding when an electronic dimming ballast is incorporated in the fixture.

Another object is to provide an EMI/RFI shield for lighting fixtures which meets and exceeds the formal standards for radiated emissions provided by the U.S. military.

Another object is to provide an EMI/RFI shield for lighting fixtures which eliminates the silk-screen process.

Another object is to provide an EMI/RFI shield for lighting fixtures which is durable when handled or routinely cleaned.

These and other objects of the invention will be apparent from the following descriptions and from the drawings.

SUMMARY OF THE INVENTION

This invention is a lighting fixture which prevents unwanted EMI/RFI emissions from radiating from the lighting fixture. The lighting fixture comprises a body forming a light-emitting opening, lighting components including at least one lamp in the body, and a lens covering the opening. The lighting fixture also includes a conductive grid across the opening.

In certain desirable embodiments, the conductive grid is a substantially planar screen and is made of stainless steel. In preferred embodiments, the grid substantially covers the opening. In some embodiments, the grid is electrically connected to the body with a plurality of conductive hold-downs and the body and grid are electrically grounded. Preferably, the lighting fixture includes an electronic dimming ballast disposed within the body.

In preferred embodiments, the lens is translucent and includes two layers, a refractive inner layer and a transparent outer layer. Preferably, the grid is spaced from the lens sufficiently to diffuse the image of the grid through the lens.

In the invention, it is highly desirable to have a seal between the lens and the body. It is also desirable that the body includes a lens frame which has the light-emitting opening, a frame seal between the lens frame and the body, and a lens seal between the lens and the lens frame. Preferably, the lens frame is electrically connected to the body.

In certain preferred embodiments, the perimeter of the grid is on a grid shelf secured to the body. It is desirable that the grid include a conductive grid frame attached to the perimeter of the grid.

In some preferred embodiments, the lighting components include at least one reflector and the at least one lamp is associated with the at least one reflector.

In highly-preferred embodiments, the at least one reflector is a plurality of reflectors and at least some of the reflectors have associated lamps. Preferably, the reflectors are positioned to direct a first portion of light centered around a first direction and a second portion of light centered around a second direction. In highly preferred embodiments, the first direction is in a downward-outward direction.

The tem "translucent" as used herein refers to permitting light to pass through but diffusing or refracting the light such that objects on the opposite side are not clearly visible, thereby causing sufficient loss of image clarity to prevent the perception of distinct images.

The term "opening" as used herein refers to the space in the lighting fixture through which the light travels from the lighting components to the room.

The term "hold-downs" as used herein refers to a wide variety of fasteners, including but not limited to a clip or a swing-out tab.

BRIEF DESCRIPTION OF THE DRAWINGS

The drawings illustrate a preferred embodiment including the above-noted characteristics and features of the invention. The invention will be readily understood from the descriptions and drawings. In the drawings:

FIG. 6A shows a comparison with the limit established by MIL-STD-461E RE102.

FIG. 6B shows a comparison with the limit established by MIL-STD-461E RE102.

DETAILED DESCRIPTION OF PREFERRED EMBODIMENTS

Figure 1:
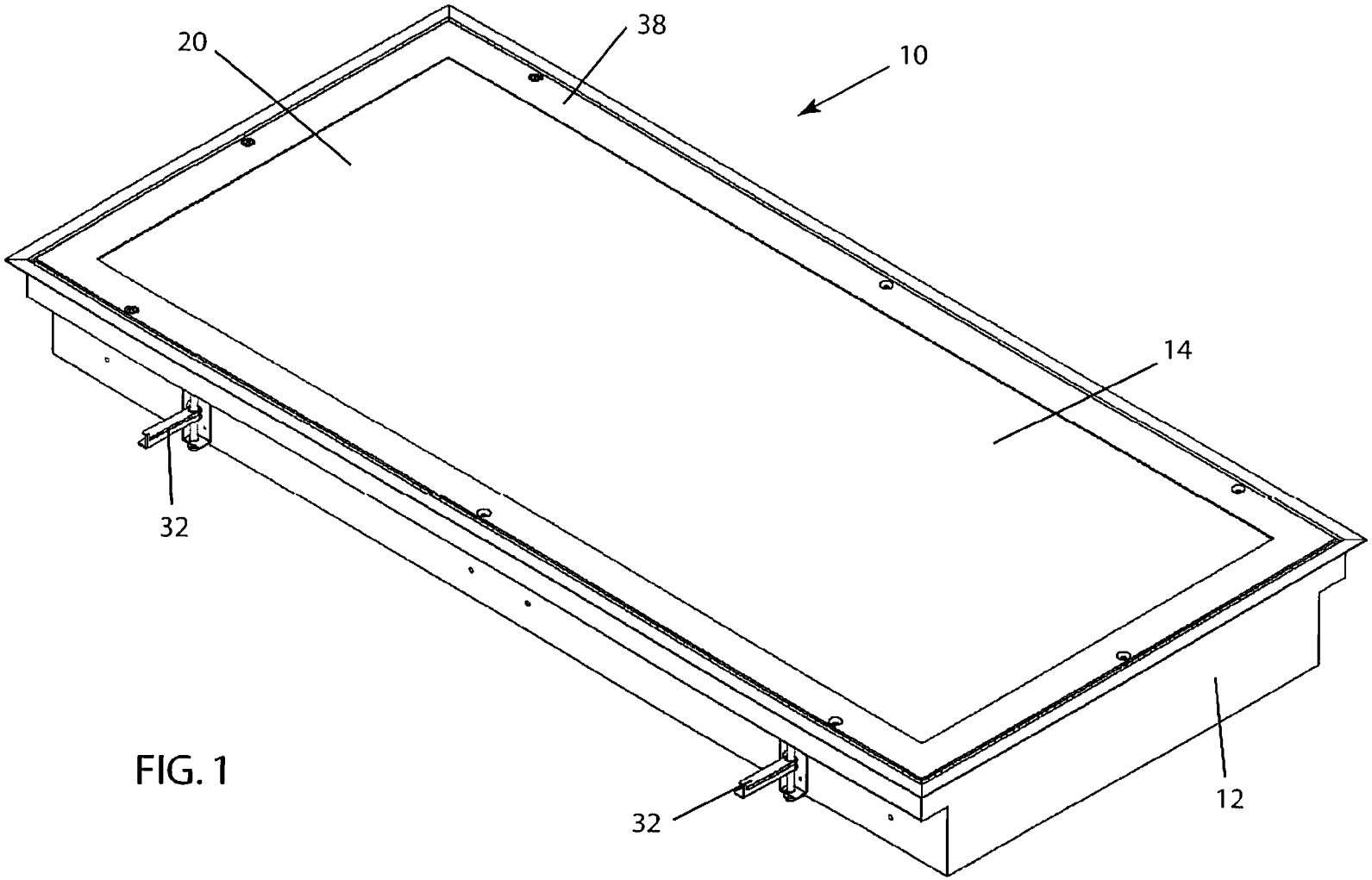
FIG. 1 is a perspective view of the lighting fixture with the lens in place.
Figure 2:
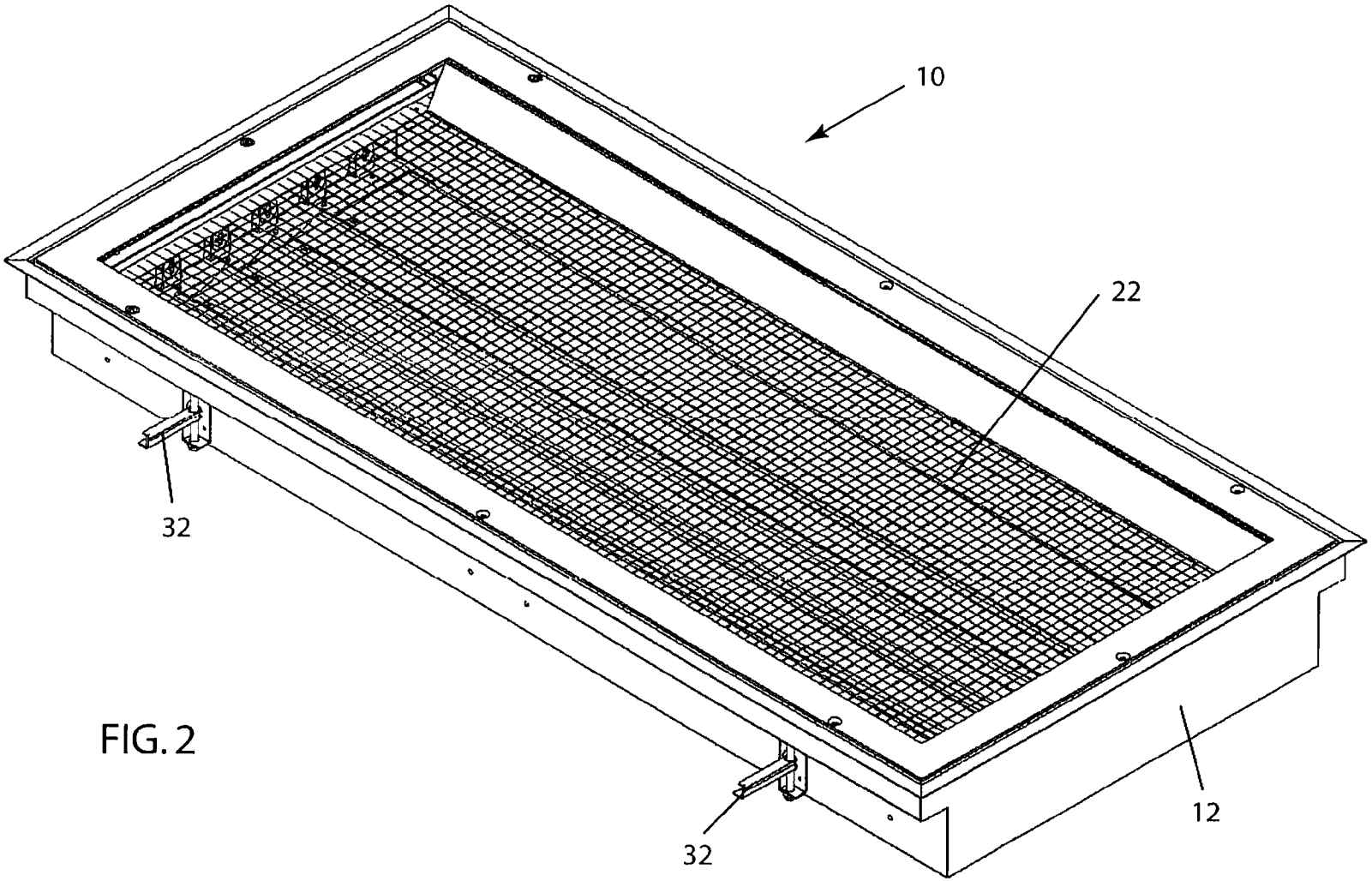
FIG. 2 is a perspective view of the lighting fixture of FIG. 1, with the lens removed to illustrate the grid within the fixture.
Figure 3:
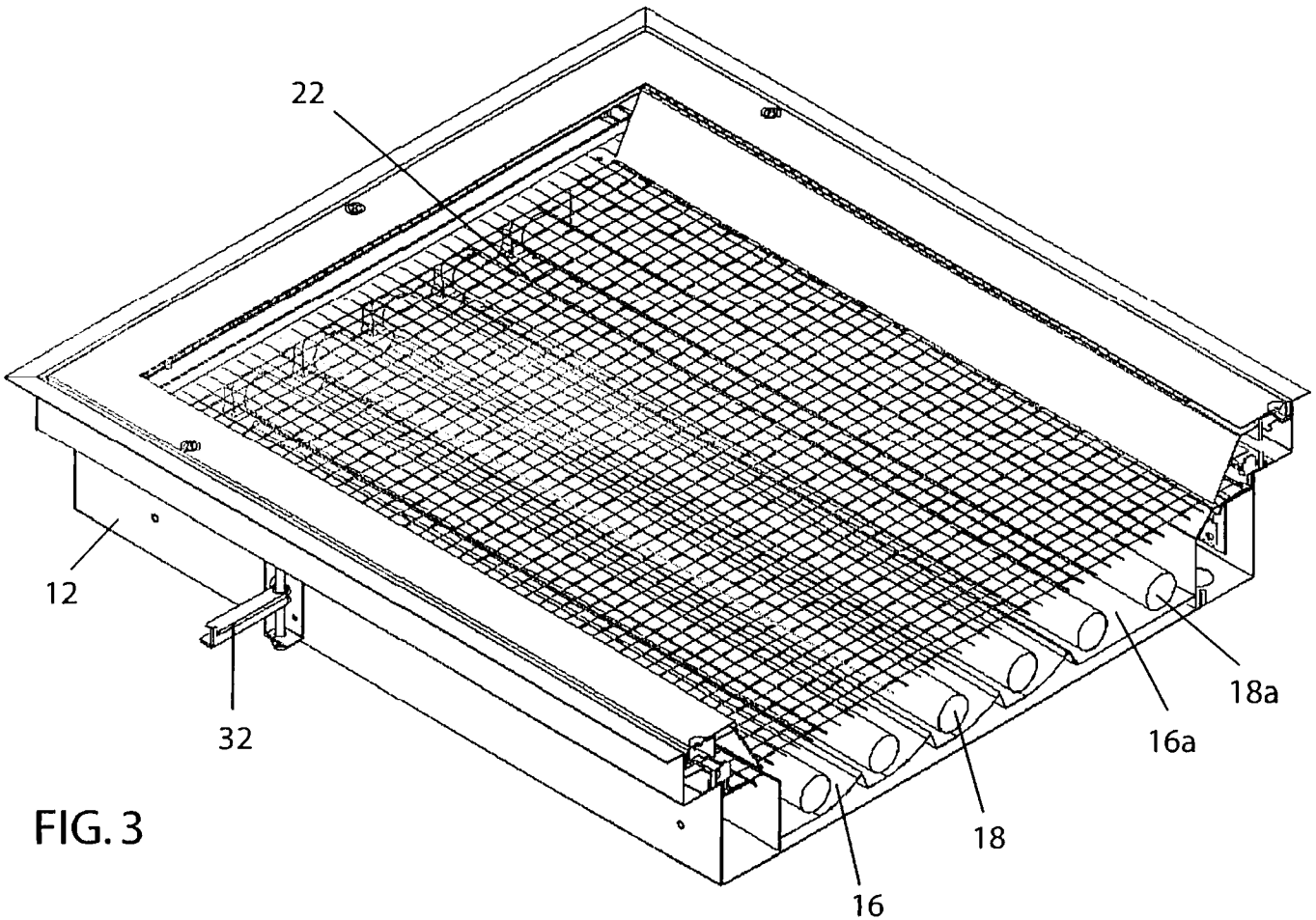
FIG. 3 is cutaway view of the lighting fixture of FIG. 1.
Figure 4:
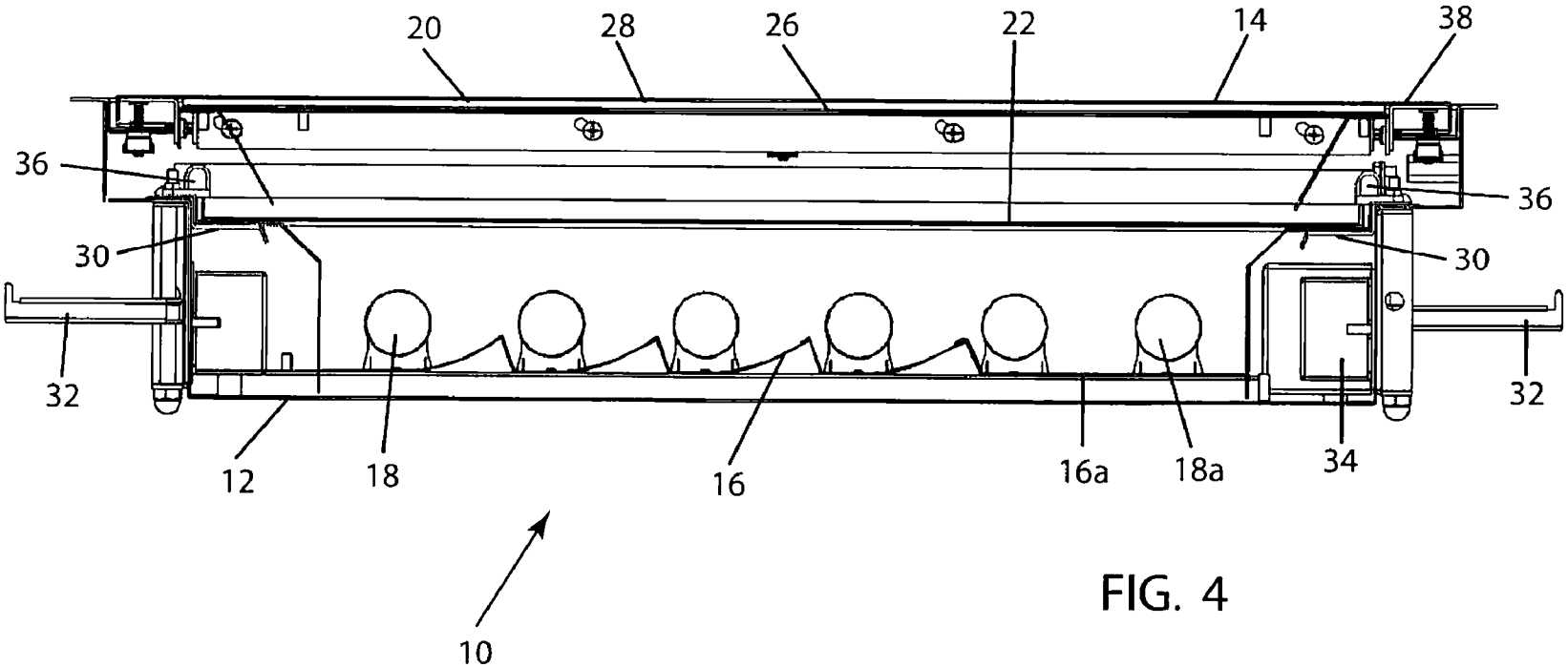
FIG. 4 is a cross-sectional view of the of the lighting fixture of FIG. 1, illustrating certain internal details.

FIGS. 1-5 illustrate an embodiment of a lighting fixture 10 having an EMI/RFI shield whereby electromagnetic interference is substantially prevented from radiating from lighting fixture 10. As shown in FIG. 1, lighting fixture 10 has a body 12 which forms a light-emitting opening 14. Body 10 also has a number of lighting components which include several reflectors 16 and 16*a* and several associated lamps 18 and 18*a* as illustrated in FIG. 3. In FIG. 3, four reflectors 16 and associated lamps 18 are included, and one reflector 16 and two associated lamps 18*a* are also installed in lighting fixture 10. As shown in FIGS. 1 and 4, body 12 includes a lens 20 which covers light-emitting opening 14. A conductive grid 22 is positioned across light-emitting opening 14. Grid 22 is a separate structure from lens 20 and grid 22 is electrically connected to body 12 as illustrated in FIG. 4.

FIG. 1 illustrates body 12 of lighting fixture 10 along with light-emitting opening 14 and lens 20 fixed in its corresponding lens frame 38. Lens frame 38 is positioned around and encompasses the perimeter of lens 20 as shown in FIG. 1.

FIG. 2 illustrates lighting fixture 10 in the same orientation as in FIG. 1 except that lens 20 has been removed and grid 22 is visible. As shown in FIG. 2, grid 22 extends across light-emitting opening 14. Reflectors 16 and 16*a* are positioned beneath grid 22 and are partially visible in FIG. 2. FIGS. 1 and 2 show a number of brackets 32 which are attached to body 12 of lighting fixture 10 so that lighting fixture 10 can be mounted in a ceiling channel (not shown). Lighting fixture 10 can be mounted in various orientations in a ceiling channel.

Figure 5:
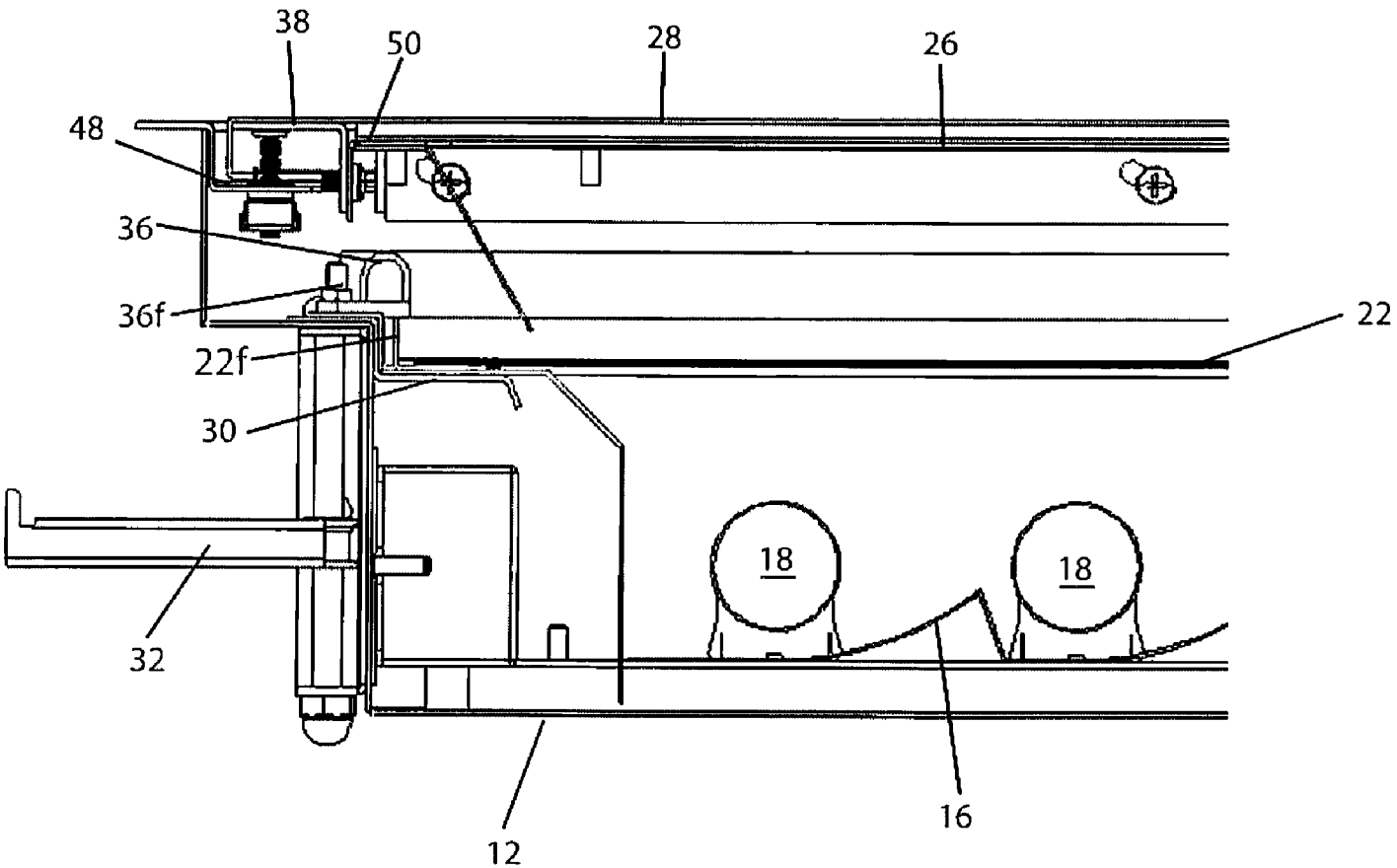
FIG. 5 is an enhanced view of a portion the cross-sectional view of FIG. 4.

As illustrated in FIG. 2, conductive grid 22 is a substantially planar screen preferably made of stainless steel. Grid 22 is electrically and mechanically connected to body 12 with several swing-out tabs 36 (hold-downs) as shown in FIG. 5. Body 12 and grid 22 are electrically grounded through the ground connection of the electrical service (not shown) to fixture 10.

Figure 7:
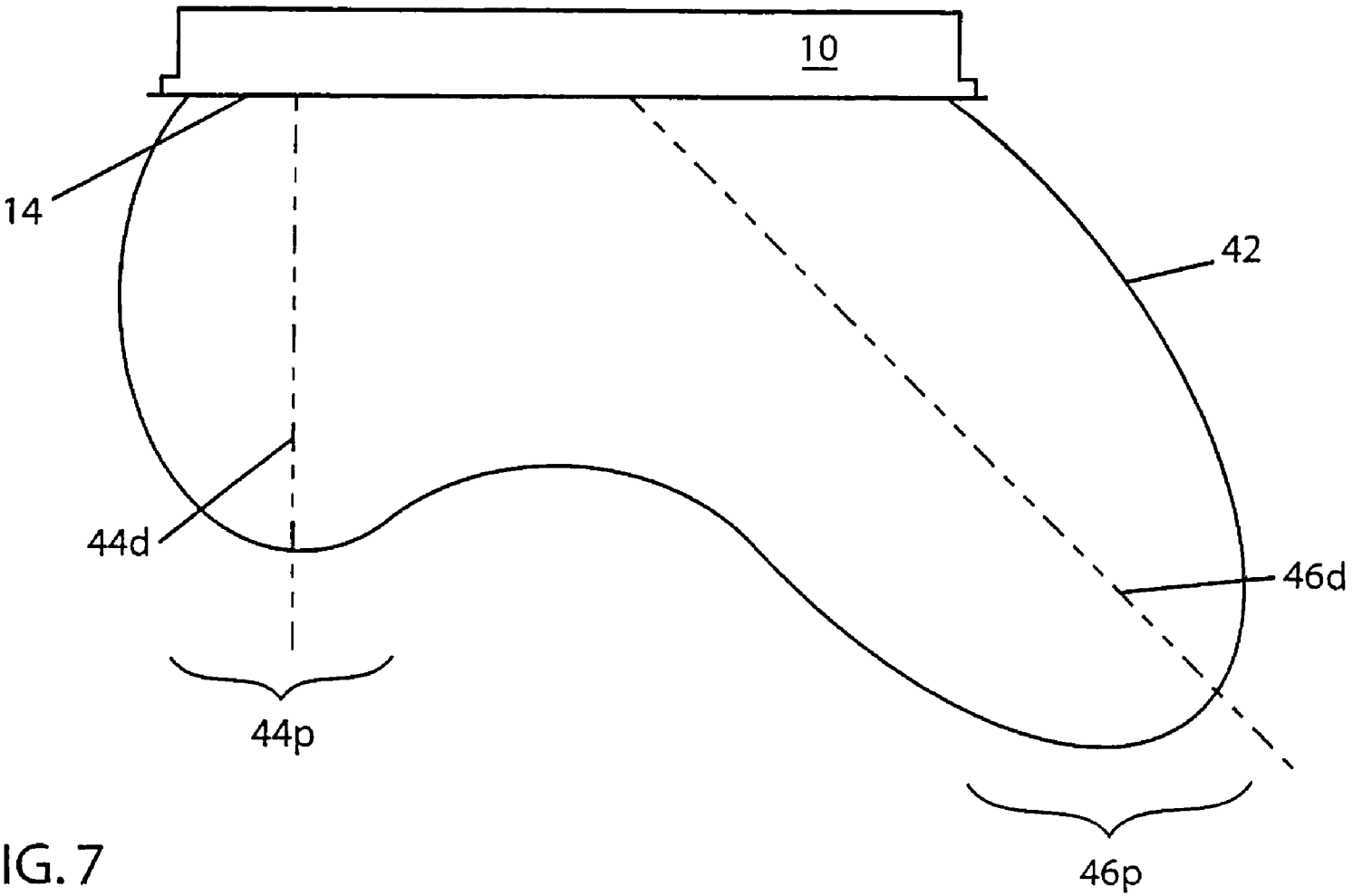
FIG. 7 is a schematic cross-section illustrating the illumination pattern of the fixture of FIG. 1.

FIG. 3 is a cutaway view of the lighting fixture 10 of FIG. 1. FIG. 3 illustrates how reflectors 16 and 16*a* and associated lamps 18 and 18*a* are positioned beneath grid 22. FIG. 3 shows four such reflectors 16 and one reflector 16*a* and their associated lamps 18 and 18*a*. As shown in FIGS. 3 and 4, each reflector 16 and 16*a* is positioned to direct light through grid 22 and through light-emitting opening 14 to create and an illumination pattern 42 as illustrated in FIG. 7.

A wide variety of illumination patterns are possible depending on the shape and position of reflectors 16 and 16*a* and lamps 18 and 18*a*. As illustrated in FIG. 7, illumination pattern 42 is represented by the dual-lobe shape labeled with reference number 42. The distance from fixture 10 to any point along pattern 42 generally represents the amount of light being emitted from lighting fixture 10 along the corresponding direction from lighting fixture 10 to the point on pattern 42 as shown in FIG. 7. In this embodiment, reflectors 16 and 16*a* are generally directing light in two directions 44*d* and 46*d*, a first portion 44*p* of light centered around a first direction 44*d* and a second portion 46*p* of light centered around a second direction 46*d* as illustrated in FIG. 7. As shown in FIG. 7, first direction 44*d* is generally downward, and second direction 46*d* is generally downward and outward. Light from lamps 18*a* and reflectors 16*a* primarily comprises the light in first portion 44*p*, and light from lamps 18 and reflectors 16 primarily comprises the light in second portion 44*p* as illustrated in FIG. 7. For example, such a dual-lobed illumination pattern is useful for illuminating a work area (not shown) and the neighboring or surrounding walls (not shown). Numerous other useful and practical illumination patterns are possible.

FIG. 4 is a cross-section of lighting fixture 10, providing an additional view of this embodiment of inventive lighting fixture 10. FIG. 4 illustrates reflectors 16 and 16*a* positioned beneath grid 22. Grid 22 is positioned in between reflectors 16-16*a* and lens 20. FIG. 4 also shows that lens 20 includes two layers, a refractive inner layer 26 and a transparent outer layer 28. As illustrated in FIG. 4, the transparent outer layer 28 is clear, providing a smooth outer surface to enable effective cleaning. Refractive inner layer 26 diffuses the light passing through opening 14 as well as diffuses the image of grid 22 as viewed from outside opening 14; grid 22 is spaced from lens 20 by a distance sufficient to diffuse the image of grid 22 as viewed through lens 20 as shown in FIG. 4. Lens 20 can also be a single layer with a refractive inner surface and a smooth transparent outer surface.

FIG. 4 also illustrates a grid shelf 30 on which and to which grid 22 is secured. Shelf 30 can be made of the same conductive material as body 12 and is electrically connected through the fabrication process of body 12 such as by welding (not shown). FIG. 4 also shows an electronic dimming ballast 34 which is housed in body 12 of lighting fixture 10. Ballast 34 is used to control lamps 18 and 18*a* and is one of a variety of ballasts available for use as illustrated in FIG. 4.

As shown in FIG. 4, body 12 includes a lens frame 38 into which light-emitting opening 14 is incorporated. FIG. 4 also shows a frame seal 48 between lens flame 38 and body 12, and a lens seal 50 between the lens 20 and lens frame 38. Preferably, lens frame 38 is electrically connected to body 12. Seals 48 and 50 serve to maintain the enclosure integrity of fixture 10, thereby enabling it to withstand frequent cleanings, including exposure to liquids.

As shown in FIG. 4, the body 12 has a plurality of adjustable brackets 32 adapted for mounting the body 12 into at least one ceiling channel. Adjustable brackets 32 are operative to swing into a position of engagement with the ceiling channel (not shown), thereby mounting fixture 10 as illustrated in FIGS. 1-5.

FIG. 5 is an enhanced view of a portion of FIG. 4 which more clearly illustrates several elements of fixture 10. Grid 22 includes a grid frame 22*f* around the perimeter of grid 22. FIG. 5 also shows a set of hold-downs 36 which are used to secure grid 22 to body 12 and to provide a good electrical connection between grid 22 and body 12. Hold-downs 36 can be selected from a variety of fasteners, including but not limited to clips or swing-out tabs. Hold-downs 36 shown in FIG. 5 are swing-out tabs secured to body 12 with threaded fasteners 36*f*.

Figure 6A:
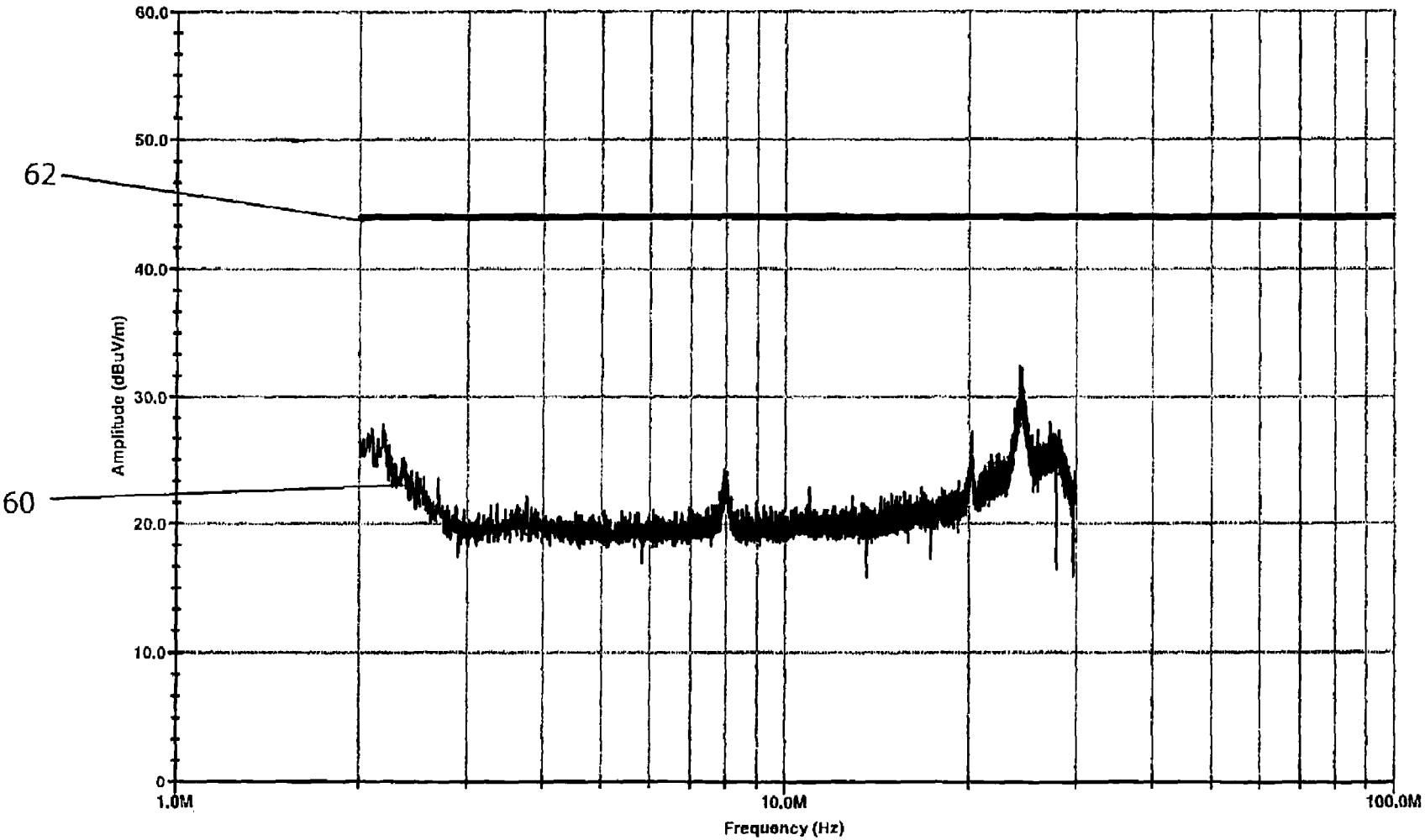
FIG. 6A presents test results of radiated emissions from the lighting fixture of FIG. 1.
Figure 6B:
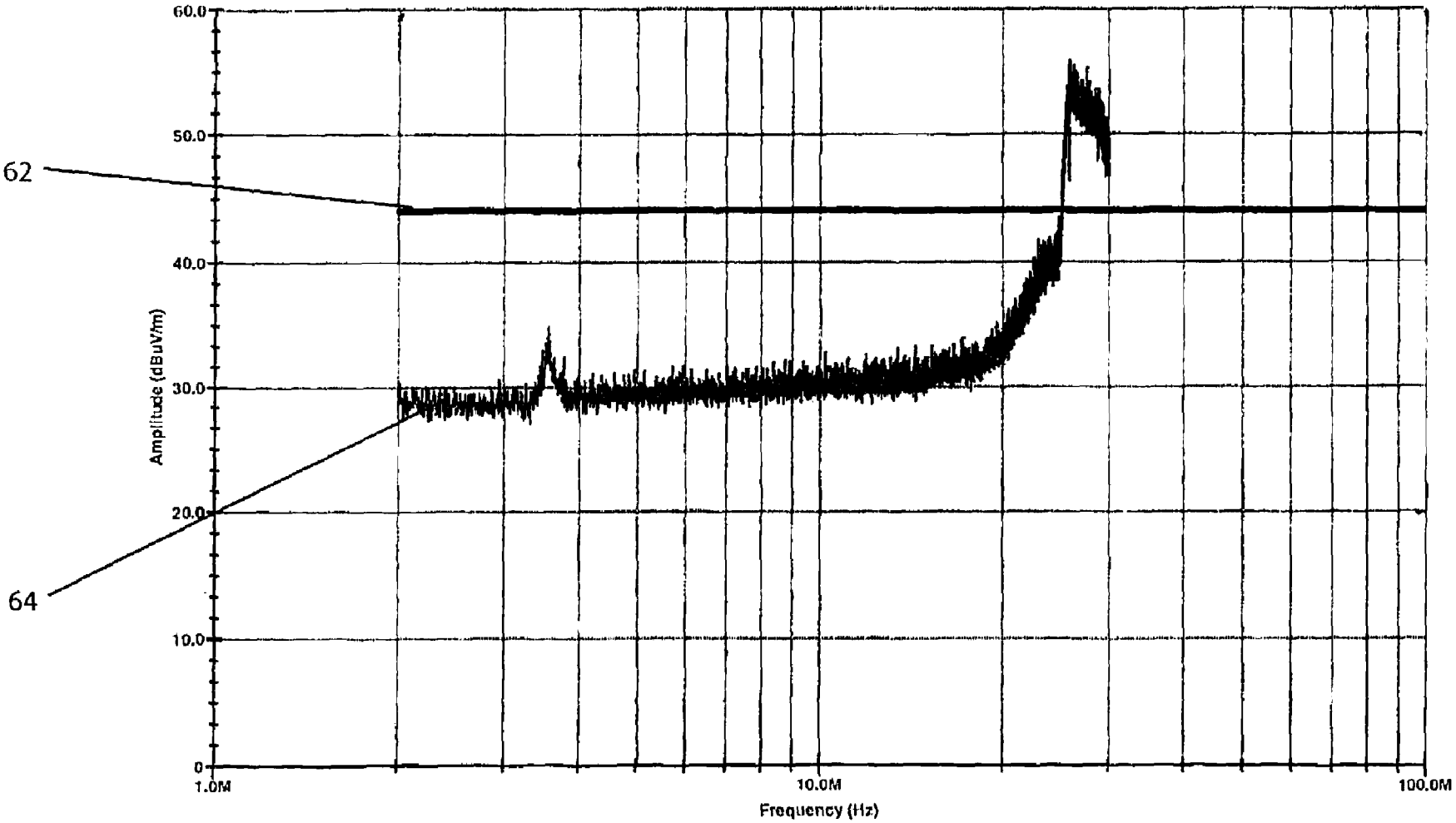
FIG. 6B presents test results of radiated emissions from a lighting fixture using a silk-screen shield of the prior art.

FIGS. 6A and 6B illustrate the shielding performance of the embodiment of fixture 10 (FIG. 6A) compared to limits set by MIL-STD-461E RE102 and the shielding performance of a prior art fixture utilizing a silk-screened conductive paint EMI/RFI shield (FIG. 6B). In fixture, 10, grid 22 is constructed of 304 stainless steel Wire 0.022" diameter and welded in a square pattern 0.478" on centers. Grid 22 includes grid frame 22*f* and is configured to be is 19" by 48". In the fixture for which FIG. 6B shows radiated emissions, the silk-screened layer has a thickness of about 0.002", and the overall fixture is otherwise of similar size and the general configuration of fixture 10. The frequency data of the two graphs in FIGS. 6A and 6B range from 2 to 30 MHz. Although radiated emissions testing is done over a much larger range (up to 1 GHz), FIGS. 6A and 6B illustrate the test results for the frequencies of greatest interest and importance for such a fixture, ranging between 2 and 30 MHZ due to the source frequencies from electronic dimming ballast 34 incorporated into fixture 10.

In FIG. 6A, the radiated emission data 60 is generally well below 30 dB μV/m (microvolts per meter) with only one small region above this level around a frequency of 24 MHz. All of the data in this frequency range is below the approximately 44 dB μV/m limit illustrated by reference number 62 established by MIL-STD-461E RE102. In FIG. 6B, the radiated emission data 64 is generally higher across the frequency range when compared to plot 60 of FIG. 6A, and the data in the region of about 25 MHz and above is above standard 62.

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. A luminaire securable with respect to a room surface, including:

a luminaire body forming a light-emitting opening, the body being mounted to a ceiling;

lighting components including at least one lamp in the body;

a lens having an inner surface covering the opening; and a conductive grid between the lighting components and the opening, the grid being a separate structure from the lens, electrically connected to the body and positioned adjacent to the lens inner surface thereacross and extending over the opening, whereby the grid prevents electromagnetic interference from radiating from the luminaire during emission of light therefrom.

2. The luminaire of claim 1 wherein the conductive grid is a substantially planar screen.

3. The luminaire of claim 2 wherein the conductive grid is made of stainless steel.

4. The luminaire of claim 1 wherein the lens is translucent.

5. The luminaire of claim 1 wherein the grid is spaced from the lens to diffuse the image of the grid through the lens.

6. The luminaire of claim 1 wherein the lens includes two layers, a refractive inner layer and a transparent outer layer.

7. The luminaire of claim 1 wherein the grid is electrically connected to the body with a plurality of conductive hold-downs.

8. The luminaire of claim 1 further including a seal between the lens and the body.

9. The luminaire of claim 1 wherein the body includes a lens frame having the light-emitting opening, a frame seal between the lens frame and the body, and a lens seal between the lens and the lens frame.

10. The luminaire of claim 9 wherein the lens frame is electrically connected to the body.

11. The luminaire of claim 1 wherein the body and grid are electrically grounded.

12. The luminaire of claim 1 wherein the perimeter of the grid is on a grid shelf secured to the body.

13. The luminaire of claim 1 wherein the grid includes a conductive grid frame attached to the perimeter of the grid.

14. The luminaire of claim 1 wherein the lighting components include at least one reflector and the at least one lamp is associated with the at least one reflector.

15. The luminaire of claim 14 including a plurality of reflectors and at least some of the reflectors have associated lamps.

16. The luminaire of claim 15 wherein the reflectors are positioned to direct a first portion of light centered around a first direction and a second portion of light centered around a second direction.

17. The luminaire of claim 16 wherein the first direction is in a downward-outward direction.

18. The luminaire of claim 1 wherein the fixture includes an electronic dimming ballast disposed within the body.

* * * * *